United States Patent [19]

Beardmore

[11] 4,054,248

[45] Oct. 18, 1977

[54] FUEL INJECTOR PUMP FOR A UNIT FUEL INJECTOR

[75] Inventor: John M. Beardmore, South Lyon, Mich.

[73] Assignee: General Motors Corporation, Detroit, Mich.

[21] Appl. No.: 701,812

[22] Filed: July 1, 1976

[51] Int. Cl.[2] ..... B05B 1/30

[52] U.S. Cl. ..... 239/88; 123/139 AK

[58] Field of Search ..... 239/88–95; 123/139 AK

[56] References Cited

U.S. PATENT DOCUMENTS

| | | | |
|---|---|---|---|
| 2,556,171 | 6/1951 | Dudek | 123/139 AK |
| 2,590,575 | 3/1952 | Rogers | 239/88 X |
| 2,996,054 | 8/1961 | Lang | 123/139 AK |

*Primary Examiner*—John J. Love
*Attorney, Agent, or Firm*—Arthur N. Krein

[57] ABSTRACT

A jerk-type fuel injector - pump unit is provided with a two-stage plunger rotatably and reciprocably journaled in the cylinders of a two-stage bushing to provide therewith a primary chamber for pumping fuel for injection and a secondary chamber for pumping fuel, with an annular fuel chamber encircling the bushing, the bushing having conventional upper and lower main fill and bypass ports in communication with the primary chamber as controlled by the first stage of the two-stage plunger with each port sequentially closable and operable by spaced helical lands on the first stage of the plunger to effect beginning and ending of injection during the pumping stroke of the plunger to discharge fuel through an outlet at the lower end of the bushing for injection into the cylinder of an engine, the bushing further having secondary port means and a lower flow control passage means, each opening at one end into said secondary chamber with flow therethrough controlled by the second stage of the plunger, the second stage of the plunger being of a larger external diameter than the diameter of the first stage and sized relative thereto so that the cross-sectional working area of the primary chamber is substantially equal to the cross-sectional working area of the secondary chamber.

8 Claims, 2 Drawing Figures

FUEL INJECTOR PUMP FOR A UNIT FUEL INJECTOR

Figure 1:
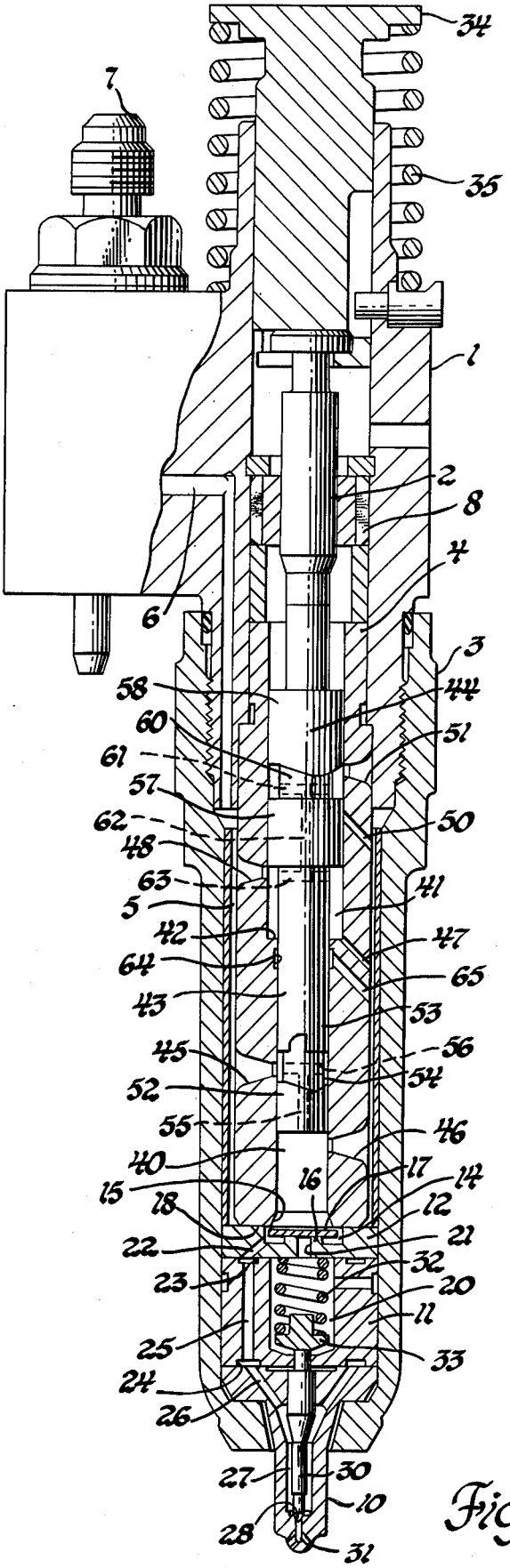

This invention relates to pressure fluid injectors, and particularly to those of the so-called "jerk" type for the injection of liquid fuel into the cylinder of an internal combustion engine. In particular, this invention relates to a two-stage, plunger-bushing arrangement for such a unit fuel injector.

It is well known that conventional jerk-type fuel injector - pump units, because of their mode of operation, generate noise. In such injector - pump units, there are two phases during the injection operating cycle of such a unit which relate directly to the creation of such noise, namely, the beginning and end of injection. Thus, noise is generated because of the pressure rate development within the unit injector and because of the high pressure release in the injector at the end of injection.

Accordingly, it is a primary object of this invention to provide an improved pump arrangement for a jerk-type, fuel injector - pump unit whereby the force rate change of the injection period is smoothed out without altering the actual injection process of such a unit which requires immediate starting and ending of injection for proper performance and emission considerations.

A further object of this invention is to provide an improved jerk-type, fuel injector - pump unit in which the pump portion of such a unit has incorporated therein a two-stage plunger whereby the plunger force is transferred rapidly from one stage to the other with the total plunger force thus smoothed out.

A still further object of this invention is to provide a unit type fuel injector with an improved plunger and bushing arrangement therein utilizing a two-stage plunger - bushing.

These and other objects of the invention are obtained in a unit injector of the type having a bushing positioned in an injector housing to form therewith an annular fuel supply chamber encircling the bushing intermediate the ends thereof and having a plunger axially and reciprocably positioned in the bushing for effecting a pumping stroke and a suction stroke, the plunger in accordance with the invention being a two-stage or stepped plunger with a first primary piston portion at one end thereof and an enlarged secondary piston next adjacent thereto, the stepped plunger being received in a two-stage or stepped cylinder as provided by a stepped bore through the bushing to form therein a primary chamber and a secondary chamber with the primary chamber having an outlet at one end of the bushing, the bushing being provided with an upper side port spaced from the outlet and a lower side port intermediate the upper side port and the outlet each opening into the primary chamber with flow therethrough controlled by spaced helical edges of the lands of the primary piston, the bushing further including in one embodiment an upper secondary side port and a lower secondary side port in communication with the secondary chamber as controlled by lands on the secondary piston portion of the plunger and further including a lower flow control passage means including bleed orifice means for the controlled discharge of fluid from the secondary chamber during a pumping stroke of the plunger. In an alternate embodiment, the lower flow control passage means is provided with a valve to control the discharge of fuel from the secondary chamber.

Figure 2:
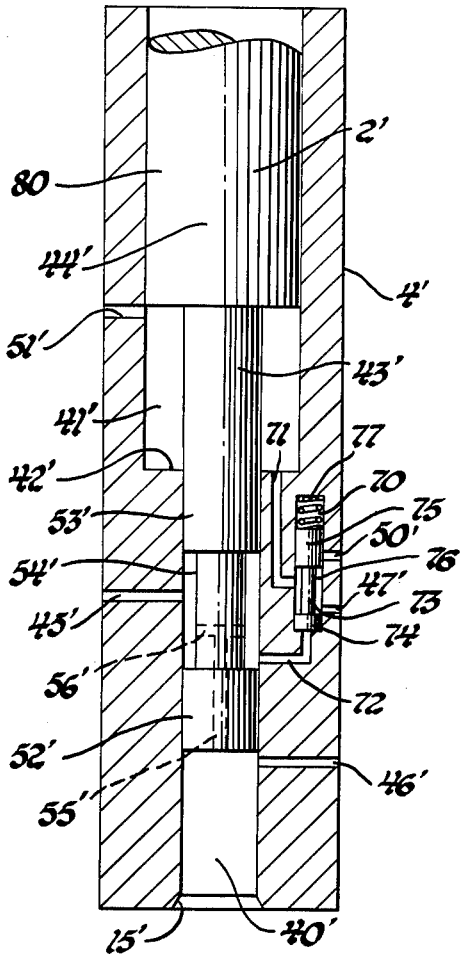

For a better understanding of the invention, as well as other objects and further features thereof, reference is had to the following detailed description of the invention to be read in connection with the accompanying drawings, wherein:

FIG. 1 is a longitudinal sectional view through a unit injector - pump assembly having incorporated therein a two-stage plunger - bushing structure in accordance with a preferred embodiment of the invention; and, FIG. 2 is a schematic view of an alternate two-stage plunger - bushing structure for a unit injector - pump assembly.

Referring first to FIG. 1, there is shown a unit injector - pump assembly having a housing 1 in which a two-stage plunger 2, to be described in detail hereinafter, is rotatably and reciprocably positioned. Forming an extension of and threaded to the lower end of the housing 1 is a nut 3 within which is supported a two-stage bushing 4, to be described in detail hereinafter, providing a pump cylinder structure for the plunger 2. An annular chamber or space 5 encircling the bushing 4 within the nut 3 is supplied with fuel via passages 6 in the housing from an external fuel connection 7 in a well-known manner.

Clamped to the lower end of the bushing 4 by the nut 3 is a fuel injector or nozzle assembly, including a valve body comprising a spray tip 10, a valve spring cage 11 and a check valve cage disk or spring retainer 12. The spring retainer 12 has a cavity 14 facing the cylinder opening or outlet 15 at the lower end of the bushing 4 and, projecting centrally upwardly from the bottom of the cavity is a protuberance 16 which forms a stop for a circular flat disk check valve 17. The cavity 14 extends laterally beyond the extremities of the cylinder opening 15 and the lower end of the bushing 4 forms a seat 18 for the check valve 17 when in position to close the opening or outlet 15. Extending centrally through the protuberance 16 and into a spring chamber 20 formed within the valve spring cage 11 is a passage 21. The upper end of the protuberance or stop 16 forms a seat for the check valve when in its position shown blocking entrance to the passage 21 from the cavity 14.

A plurality of circumferentially spaced, inclined passages 22 are also provided in the spring retainer 12 to connect the cavity 14 with an annular groove 23 in the upper end of the valve spring cage 11, this groove 23 being connected with a similar annular groove 24 on the bottom face of the valve spring cage by a longitudinal passage 25 through the valve spring cage and, the lower groove 24 is, in turn, connected by one or more inclined passages 26 to a central passage or chamber 27 surrounding a needle valve 30 reciprocably positioned within the spray tip 10. At the lower end of this passage 26 is an outlet for fuel delivery in the form of a tapered seat 28 for the needle valve 30 below which are connecting spray orifices 31 in the lower end of the spray tip 10.

The needle valve 30 is normally biased to a closed position in abutment against the seat 28 by a coil spring 32 positioned in the valve spring cage 11 with one end thereof in abutment against the spring retainer 12 and its other end abutting against a spring seat 33 which, in turn, abuts against the reduced stem end of the needle valve 30 which slidably extends through an aperture provided for this purpose in the lower end of the valve spring cage 11 into the spring chamber 20.

Other details of the upper portion of the unit fuel - pump assembly are not important to the present invention, and are common to the construction shown and described in such prior art patents as U.S. Pat. No.

2,951,643 entitled "Fuel Injector with Pilot Injection" issued Sept. 6, 1960 to Royce G. Engel, Jr. and U.S. Pat. No. 2,898,051 entitled "Fluid Injection Device" issued Aug. 4, 1959 to Conrad A. Teichert and, hence, will not require further description here. For further details of the fuel injector or nozzle assembly, reference is made herein to U.S. Pat. No. 3,075,707 entitled "Fuel Injector Pump with Hydraulically Controlled Injection Valve" issued Jan. 29, 1963 to Thomas E. Rademaker, since a more detailed description of the fuel injection or nozzle portion of the fuel injector - pump assembly need not be considered herein since the details of such a fuel injector or nozzle assembly form no part of the subject invention. It should also be realized that other forms of fuel injector or nozzle assemblies could readily be incorporated into such a unit injector, as will be apparent to those skilled in the art.

Referring now to the subject matter of the invention, the bushing 4 is provided with a stepped bore therethrough to define at one end thereof, the lower end with reference to FIG. 1, a first or primary cylinder 40 with the outlet 15 at one end thereof and at its other end an enlarged second or secondary cylinder 41 interconnected to the primary cylinder by a shoulder 42, whereby in effect, the bushing 4, although shown as a unitary structure, may be considered to be a double bushing, with each having a different size central aperture therethrough.

The plunger 2, rotatably and reciprocally journaled in the bushing 4, is a stepped or two-stage plunger and includes a lower or primary piston 43 and an upper or secondary piston 44. As shown, the lower or primary piston 43 is reciprocably journaled in the primary cylinder 40 of the bushing to form therewith a primary chamber or pump chamber used to effect delivery of fuel under pressure to the fuel injector or nozzle assembly of the unit injector, while the upper or secondary piston 44, which is of a predetermined larger diameter than the primary piston, is reciprocably received within the secondary cylinder to form therewith a secondary chamber for fuel, the upper portion of the primary piston 43 extending up into this secondary chamber to in part define this secondary chamber.

Again referring to the bushing 4, it is provided with at least an upper side port 45 and a lower side port 46 to permit fluid communication between the primary cylinder 40 and the annular fuel space 5 and, in a preferred embodiment, it is provided, starting at the lower end relative to secondary cylinder 41, with a predetermined small diameter bleed orifice 47, a lower secondary side port 48, a predetermined large diameter bleed orifice 50 and an upper secondary side port 51, in predetermined space apart relationship to each other, for a purpose to be described, whereby to permit fluid communication between the secondary cylinder 41 and the annular fuel space 5. As shown, the cylinder end of bleed orifice 47 is located adjacent to the bottom, as defined by shoulder 42, of the secondary cylinder 41.

The primary piston 43 of plunger 2 is provided with the usual spaced apart lower and upper lands 52 and 53, respectively, with an external annular main metering groove 54 therebetween, by which opening and closing of ports 45 and 46 in the bushing 4 are controlled, and connecting axial and transverse passages 55 and 56, respectively, for bypassing fuel from the primary cylinder 40 to the annular fuel space 5 when the groove 54 is in registry with one or the other of the ports 45 and 46. As is well known and in accordance with conventional practice, the main metering groove 54 has that edge portion or control edge of the upper land 53 which traverses upper port 45 and that edge portion or control edge of the lower land 52 which traverses the lower port 46, each inclined, as desired, helically of the axis of plunger 2, and the plunger is axially rotatable by means of a pinion 8 on the plunger and by a rack, not shown, to thereby regulate injection timing and to regulate the fuel charge per cycle, as desired. Thus, during each downward or pumping stroke of the plunger from its position shown (effected by means of, for example, an engine rocker, not shown, engaging the follower 34), fuel is initially bypassed to the fuel space 5 from the primary cylinder below the primary piston 43, but after the groove 54 is moved out of registry with the upper port 45 and the lower port 46 is closed by the land 52, fuel is displaced under high pressure through the outlet 15 until the groove 54 moves into registry with the lower port 46 to again bypass the fuel and end injection.

Upon the completion of the so-called pumping stroke, the rocker arm, not shown, would be retracted whereby the return of the plunger 2 on its suction stroke to the position shown can be effected by a spring 35 which, as shown, may be interposed for this purpose between the housing 1 and the head of the follower, the plunger 2 being suitably connected to the follower 34, in a well-known manner, to effect this function. Such fuel charge delivered from the primary cylinder 40 is delivered to the injection or nozzle assembly of the unit for discharge in a conventional manner.

The secondary piston 44 of plunger 2 is provided in the preferred embodiment, shown in FIG. 1, with spaced apart lower and upper lands 57 and 58, respectively, with an external annular secondary groove 60 therebetween, by which opening and closing of the ports 51 and 48 and the large bleed orifice 50 in the bushing 4 are controlled. As shown, the secondary groove 60 has the edge portions or control edges of the lower and upper lands 57 and 58, respectively, which traverse the ports 51 and 48, respectively, and which traverse the large bleed orifice 50 inclined helically to the axis of the plungers. As shown, the control edge of the upper land 58 is shaped to conform to the control edge of the lower land 52 of the primary piston. In a similar manner, the control edge of the lower land 57 of the secondary piston would be shaped to conform to the control edge of the upper land 53 of the primary piston but, in the embodiment illustrated, would be diametrically opposed to that shown for the upper land 53 and, accordingly, is not seen in FIG. 1. Thus, the helices on the secondary piston are preferably shaped to conform to those used in the primary stage and in registry therewith, in the manner described, so that the pressure switching, as disclosed in detail hereinafter, between stages occurs at all rack positions (load demands). Thus, preferably, events of the secondary stage should be timed according to those of the primary stage. Connecting transverse and axial passages 61 and 62, respectively, in the secondary piston and transverse passage 63 in the upper end of the primary piston 43, are provided for bypassing fuel from the secondary chamber in the secondary cylinder 41 to the annular fuel space 5 when the groove 60 is in registry with one or the other of the ports 51 and 48 or with the large bleed orifice 50.

It will be apparent that the longitudinal spacing of the ports 48 and 51 and of the large bleed orifice 50 are correlated with the axial spacing of the lower and upper lands 57 and 58, respectively, of the secondary piston 44 and to the axial extent of the groove 60.

Preferably, the primary piston 43 and the secondary piston 44 have their outside diameters sized relative to each other so that the primary chamber and secondary chamber are of substantially the same cross-sectional area so that the volume of fuel in these chambers during the pumping stroke will be substantially the same, taking into consideration, of course, any possible leakage from these chambers in the clearance space between the exterior peripheral surfaces of the plunger 2 and the internal peripheral surfaces of the bushing 4.

To control such leakage between chambers, there is provided an annular groove 64 in the wall of the primary cylinder 40 closely adjacent to the shoulder 42 but axially spaced therefrom, which is connected by a radial passage 65 to the annular fuel space 5.

In the operation of this embodiment of FIG. 1, when the plunger 2 is at the top of its stroke, the position shown in FIG. 1, the upper port 45 and lower port 46 to primary cylinder 40 are open, permitting a charge of fuel to enter the primary chamber as formed in part by the primary cylinder 40. At the same time, the upper secondary port 51 and lower secondary port 48 to the secondary cylinder are open, permitting fuel to enter the secondary chamber as formed in part by the secondary cylinder 41. Thus, both stages or chambers are supplied with a charge of fuel. As shown in FIG. 1, the small bleed orifice 47 is always open to the secondary cylinder, but the large bleed orifice 50 to this cylinder is closed by land 57 on the secondary piston at this point in operation.

As the plunger 2 begins its travel, both secondary ports 51 and 48 are closed, the pressure in the secondary chamber will gradually increase, but this pressure is partly bled by the discharge of fuel through the small bleed orifice 47 into the annular fuel space 5 until the start of injection. As the plunger continues on its downward stroke, both the primary upper and lower ports 45 and 46, respectively, will close so that a rapid pressure rise will then occur within the primary chamber. Simultaneously, the large bleed orifice 50 for the secondary cylinder will be uncovered when the upper edge of the lower land 57 of the secondary piston traverses this bleed orifice thereby relieving the pressure in the secondary cylinder, with fuel flowing from the lower portion of this secondary cylinder through the passages 63, 62 and 61 out through the large bleed orifice 50 and, of course, fuel will also flow out through the always open small bleed orifice 47. Fuel will be continuously discharged from the primary cylinder until the lower port 46 is uncovered so that pressure may be relieved from this stage by the flow of oil up through the passages 55 and 56 for discharge out through this side port. At the same time, the large bleed orifice 50 is reclosed by passage of the upper land 58 thereacross so that the pressure will then again increase within the secondary cylinder. As the plunger continues to the bottom of its travel on the pumping stroke, the pressure within the secondary cylinder acting on the plunger will be gradually relieved due to the controlled passage of fuel out through the small bleed orifice 47, which as noted previously is always open to the bottom of this secondary cylinder.

Referring now to FIG. 2, there is shown an alternate embodiment of a two-stage plunger and bushing assembly, in accordance with the invention, which has incorporated therein a shuttle valve to control the flow of fuel from the second or secondary stage of this assembly.

The bushing 4' like the bushing 4 is provided with a stepped bore therethrough to define at one end thereof, the lower end with reference to FIG. 2, a first or primary cylinder 40' having an outlet 15' at its lower end and, at its other end, a second or secondary enlarged primary cylinder 41' with a radial annular shoulder 42' therebetween.

The plunger 2', rotatably and reciprocably journaled in the bushing 4', is a stepped or two-stage plunger that includes a lower or primary piston 43' and an upper or secondary piston 44'.

The bushing 4' is provided with the usual upper side port 45' and lower side port 46' opening into the primary cylinder 40' and this bushing is further provided with an upper secondary side port 51' into the secondary cylinder 41' and, in addition, it is provided with an upper large bleed orifice 50' and a lower small bleed orifice 47' in fluid communication with a cylindrical valve chamber 70 which, in turn, is connected intermediate its ends by a flow control passage 71 opening into the secondary cylinder 41', as by extending through the shoulder 42' and, in addition, the cylindrical valve chamber 70 is connected at one end, the lower end with reference to FIG. 2, by a passage 72 to the primary cylinder 40' intermediate the ports 45' and 46', for a purpose to be described.

Reciprocably positioned within the cylindrical valve chamber 70 is a shuttle valve, generally designated 73, this valve having a lower land 74 and an upper land 75 with an external annular groove 76 therebetween, the lower land 74 being adapted to control the flow of fuel through the small bleed orifice 47', while the upper land 75 is used to control the flow of fuel through the upper large bleed orifice 50', with a spring 77 being positioned in the cylindrical valve chamber so as to normally bias the valve 73 toward the bottom of this chamber, with reference to FIG. 2, whereby the land 75 is normally positioned to block flow through the upper enlarged bleed orifice 50' and thereby normally place bleed orifice 47' in fluid communication, via passage 71, with the secondary cylinder 41'.

The primary piston 43' of the plunger is provided with the usual spaced apart lower and upper lands 52' and 53', respectively, with an external annular metering groove 54' therebetween, by which opening and closing of the ports 45' and 46' in the bushing 4' are controlled, and connecting axial and transverse passages 55' and 56', respectively, for bypassing fuel from the primary cylinder 40' to the annular fuel space 5 when the groove 54' is in registry with one or the other of the ports 45' and 46'. The secondary piston 44' of the plunger is, in this alternate embodiment, provided with a continuous land 80 by which opening and closing of the upper secondary port 51' for the secondary cylinder 41' is controlled. As schematically shown in FIG. 2, the control edges of both the lower and upper lands 52' and 53', respectively, of the primary piston 43' and the control edge of the secondary piston 44', that is, the edge of this secondary piston which controls the opening and closing of port 51' are all shown schematically as providing constant event timing. However, it will be apparent to those skilled in the art that these control edges can be inclined helically, as desired, in accordance with the description of the corresponding control edges previously made in regard to the embodiment of FIG. 1.

In the operation of this alternate embodiment, when the plunger 2′ is at the top of its stroke, the position shown in FIG. 2, the primary upper and lower ports 45′ and 46′, respectively, are open permitting a charge of fuel to enter the primary chamber 40′ and, at the same time, the upper secondary port 51′ is uncovered allowing fuel to enter the secondary cylinder 41′. Since at this stage of operation the fuel in both the primary and secondary cylinders is at a relatively low supply pressure from the annular space 5, the spring 77 is operative to bias the valve 73 to a position, the position shown in FIG. 2, whereby the small bleed orifice 47′ is in fluid communication with the secondary cylinder 41′ via the annular space within the chamber 70 encircling the groove 76 of the valve and via the passage 71.

As the plunger 2′ begins to move downward on the pumping stroke, the secondary upper port 51′ is closed and, since the initial plunger velocity is low during this phase of the operation, the initial pressure build-up in the secondary cylinder 41′ increased gradually. This pressure from the secondary cylinder 41′ is bled through the small bleed orifice 47′ until such time as both the upper and lower ports 45′ and 46′ to the primary cylinder 40′ are closed. As this occurs, the pressure builds up rapidly within the primary stage, that is, in primary cylinder 40′, (since plunger velocity at this time is near maximum), whereby this pressure acts against one side of the valve 73 via passage 72 to overcome the force of spring 77 and move the valve 73 to a position at which the lower land 74 will block flow through the small bleed orifice 47′ while the upper land 75 thereof is moved to a position whereby large bleed orifice 50′ is uncovered so that the pressure (force) within the secondary cylinder 41′ can be relieved more rapidly but at a predetermined rate depending on the size of the orifice 50′. As the actual injection process proceeds, the pressure within the primary cylinder 40′ increases at a rapid rate while the pressure of the fuel within the secondary cylinder 41′ decreases, so that the total force acting on the plunger by the fluid within these cylinders is significantly smoothed out.

At the instant the primary lower port 46′ is uncovered, the pressure within the primary cylinder 40′ immediately drops to a minimum corresponding to the fuel pressure in the fuel supply annular space 5. As this occurs, the valve 73 will be immediately biased by the force of spring 77 to the bottom of the valve chamber 70, the position shown in FIG. 2, thereby closing the large bleed orifice 50′ and reopening the small bleed orifice 47′, thus allowing the pressure within the secondary chamber 41′ to increase at a predetermined rate since fuel is now only discharged through the small bleed orifice 47′. As the plunger 2′ continues to the bottom of its pumping stroke, the pressure acting against this plunger is developed entirely within the secondary stage of this assembly, that is, within the secondary cylinder 41′, and this pressure is then gradually reduced, somewhat proportional to the plunger velocity decline during the termination of the pumping stroke by the flow of fuel out through the small bleed orifice 47′.

From the above description of the operation of both embodiments of the two-stage plunger-bushing arrangement disclosed, it will be apparent that the force rate changes acting on the plunger over the injection period, that is, during the pumping stroke of the plunger, will be smoothed out without altering the actual injection process of the fuel injection pump portion of this assembly, that is, the injection process will immediately start and end injection in a normal manner for proper engine performance and emission consideration.

What is claimed is:

1. A unit fuel injector - pump including a housing, a bushing positioned in said housing to form therewith a fuel supply chamber externally of said bushing and connectable to a source of fuel, said bushing having a pump cylinder therein with an inlet for fuel from said fuel supply chamber opening into said pump cylinder intermediate its ends and an outlet associated therewith at one end of said bushing, a plunger having a piston reciprocable in said pump cylinder for displacing fuel therefrom via said outlet and, a fuel injector nozzle assembly secured to said one end of said bushing to receive fuel discharged therefrom, said bushing further having an enlarged secondary pump cylinder therein on the opposite side of said pump cylinder from said outlet, said secondary pump cylinder having at least one secondary side port for the ingress of fuel into said secondary pump cylinder and a flow control passage means axially spaced from said secondary side port for effecting controlled fluid flow communication between said secondary pump cylinder and said fuel supply chamber and, said plunger further having an enlarged secondary piston portion reciprocable in said secondary pump cylinder to control inlet fuel flow through said secondary port into said secondary pump cylinder and to effect the discharge of fuel from said secondary pump cylinder through said flow control passage means to said fuel supply chamber.

2. A unit fuel injector - pump including a housing, a bushing positioned in said housing to form therewith a fuel supply chamber externally of said bushing and connectable to a source of fuel, said bushing having a pump cylinder therein with an outlet associated therewith at one end of said bushing, a plunger having a piston portion reciprocable in said pump cylinder and displacing fuel therefrom via said outlet and, a fuel injector nozzle assembly secured to said one end of said bushing to receive fuel discharged therefrom, said bushing further having an enlarged secondary pump cylinder therein coaxial with said pump cylinder opposite said outlet and having an upper secondary side port and a lower secondary side port in longitudinal spaced apart relation to each other and with said lower secondary side port located between said upper secondary side port and said pump cylinder each connecting said secondary pump cylinder to said fuel supply chamber, said bushing further having a first bleed orifice, of predetermined diameter, positioned between said upper secondary side port and said lower secondary side port and a second bleed orifice, of predetermined diameter, located on the side opposite of said lower secondary side port from said first bleed orifice with each interconnecting said secondary pump cylinder to said fuel supply chamber, said second bleed orifice being located to open into said secondary pump cylinder on the end thereof next adjacent to said pump cylinder and, said plunger further having an enlarged secondary piston portion reciprocable in said secondary pump cylinder and having an upper secondary land and lower secondary land operative to close the cylinder ends of said upper secondary side port and said first bleed orifice and to close said lower secondary side port, respectively, during a pumping stroke of said plunger and an annular secondary groove between said upper secondary land and said lower secondary land and, passage means in said plunger connecting said annular secondary groove to the remote end of said secondary lower land.

3. A unit fuel injector - pump including a housing, a bushing positioned in the housing to form therewith a fuel supply chamber externally of said bushing that is connectable to a source of fuel, said bushing having a pump cylinder therein open at one end of said bushing to provide an outlet, a plunger having a piston portion reciprocable in said pump cylinder and displacing fuel therefrom via said outlet and, a fuel injector nozzle assembly secured to said one end of said bushing to receive fuel discharged therefrom, said bushing further having an enlarged secondary pump cylinder therein aligned with said pump cylinder on the end thereof opposite said outlet and having at least one secondary side port interconnecting said secondary pump cylinder to said fuel supply chamber, said bushing further having a cylindrical valve chamber therein, a first passage in communication at one end with said secondary pump cylinder at the end thereof next adjacent to said pump cylinder and in communication at its opposite end with said valve chamber intermediate the ends thereof, a second passage in communication at one end with said pump cylinder intermediate the ends thereof and in communication at its other end with one end of said valve chamber, a first bleed orifice of predetermined diameter and a second bleed orifice of predetermined diameter each opening from said fuel supply chamber into said valve cylinder on opposite sides of said first passage, a shuttle valve slidably positioned in said valve chamber for movement therein to selectively place said first bleed orifice and said second bleed orifice in fluid communication with said first passage via said valve cylinder and, biasing means positioned in said valve chamber to normally bias said valve to a position whereby said second bleed orifice is normally in fluid communication with said first passage and, said plunger further having an enlarged secondary piston portion reciprocable in said secondary pump cylinder to control flow through said secondary side port and to effect discharge of fuel from said secondary pump cylinder through said first passage with flow therefrom through said first bleed orifice and said bleed orifice selectively controlled by said valve with positioning of said valve controlled by said biasing means and fluid pressure in said second passage.

4. In a fuel injection pump of the type having a bushing positioned in an injector housing to form therewith an annular fuel supply chamber encircling said bushing intermediate the ends thereof and a plunger axially and reciprocably positioned in said bushing for effecting a pumping stroke and a suction stroke, said bushing having a stepped bore therethrough defining an outlet at one end thereof and providing, in succession starting from said one end, a cylindrical walled first cylinder and a second cylinder of larger inside diameter than said first cylinder interconnected thereto by an annular radial shoulder, said plunger being stepped to define a first piston and a second piston positioned in said first cylinder and said second cylinder, respectively, said bushing having an upper side port spaced from said outlet and a lower side port intermediate said first side port and said outlet, each opening into said first cylinder from said supply chamber, said bushing further having at least one secondary side port and a flow control passage means each opening at one end into said second cylinder from said fuel sypply chamber with flow through said secondary side port controlled by said second piston, said first piston having an upper land and a lower land operative to close the cylinder ends of said upper side port and said lower side port, respectively, during longitudinal movement of said plunger toward said outlet on the pumping stroke, said first piston having a circumferentially extending groove intermediate of and defined by edges of said upper land and said lower land and longitudinal passage means connecting said main groove to the end of said first piston remote from said second piston, said second piston having land means thereon operative to close the cylinder end of at least said one upper secondary side port during longitudinal movement of said plunger toward said outlet on the pumping stroke of said plunger.

5. In a fuel injection pump according to claim 4 wherein said bushing has two secondary said ports including an upper secondary side port and a lower secondary side port in longitudinal spaced apart relation to each other and, wherein said flow control passage means includes a first bleed orifice, of predetermined diameter, positioned between said upper secondary side port and said lower secondary side port and a second bleed orifice, of predetermined diameter, located in said bushing on the side opposite of said lower secondary side port from said first bleed orifice next adjacent to said first cylinder and, wherein said second piston has a secondary upper land and a secondary lower land with an annular secondary groove therebetween, said secondary upper land and said second lower land being operative to close the cylinder ends of said upper secondary side port and said first bleed orifice and to close said lower secondary side port, respectively, during longitudinal movement of said plunger on said pumping stroke and, passage means including a longitudinal passage in said plunger connecting said annular secondary groove to the remote end of said secondary lower land.

6. In a fuel injection pump according to claim 4 wherein said flow control passage means includes a cylindrical valve chamber in said bushing, a first passage in communication at one end with said second cylinder next adjacent said first cylinder and at its opposite end to said valve chamber intermediate the ends thereof, a second passage connected at one end to said first cylinder intermediate said upper side port and said lower side port and at its opposite end to one end of said valve chamber, a first bleed orifice, of predetermined diameter, and a second bleed orifice, or predetermined diameter, each opening from said fuel supply chamber into said valve cylinder on opposite sides of said first passage, a shuttle valve slidably positioned in said valve chamber and, biasing means positioned in said valve chamber to normally bias said valve to a position in which said valve blocks flow through said second passage and said first bleed orifice.

7. A plunger type fuel injection pump including a bushing having a stepped bore therethrough and having a discharge outlet associated with one end thereof, said stepped bore providing a primary cylinder extending from said one end and providing said outlet and a secondary cylinder of a predetermined diameter greater than said primary cylinder, said bushing having an upper side port spaced from said outlet and a lower side port located intermediate said upper side port and said outlet each opening into said primary cylinder, a fuel supply chamber encircling said bushing and interconnecting said upper side port and said lower side port externally of the bushing and, a stepped, two-stage plunger having a primary piston portion and a secondary piston portion axially and reciprocably positioned in said primary cylinder and said secondary cylinder, respectively, for movement on a pumping stroke and a suction stroke, said primary piston portion having an upper land and a lower land operative to close the cylinder ends of said upper side port and said lower side port, respectively, during longitudinal movement of said plunger toward said outlet on said pumping stroke, said primary piston portion having a circumferentially extending groove intermediate and defined by said upper land and said lower land, and a longitudinal passage connecting said main groove to the remote end thereof of said lower land, said bushing including an upper secondary side port and a lower secondary side port each opening into said secondary cylinder from said fuel supply chamber, a first bleed orifice, of predetermined diameter, positioned between said upper secondary side port and said lower secondary side port and a second bleed orifice, of predetermined diameter, positioned between said lower secondary side port and the end of said secondary cylinder adjacent to said primary cylinder opening into said secondary cylinder from said fuel supply chamber, said secondary piston portion having an upper secondary land and a lower secondary land operative to close the cylinder ends of said upper secondary side port and said lower secondary side port, respectively, said upper secondary land being also operative to close the cylinder end of said first bleed orifice during longitudinal movement of said plunger toward said outlet on said pumping stroke, said secondary piston portion having a circumferentially extending secondary groove intermediate of and defined by said upper secondary land and said lower secondary land and passage means connecting said secondary groove to the remote end of said lower secondary land from said secondary groove.

8. A plunger type fuel injection pump including a bushing having a stepped bore therethrough providing a secondary cylinder and, a primary cylinder with an outlet at one end of said bushing, an upper side port spaced from said outlet and a lower side port located intermediate said upper side port and said outlet opening into said primary cylinder, a housing means encircling said bushing in spaced apart relation thereto to define therewith an annular fuel supply chamber in fluid communication with said upper side port and said lower side port, said bushing further having a cylindrical valve chamber provided by an internal cylindrical wall and spaced apart first and second end walls, a first passage interconnecting the end of said secondary cylinder next adjacent to said primary cylinder to said valve chamber intermediate the ends of said cylindrical wall, a second passage interconnecting said primary cylinder intermediate said upper side port and said lower side port with said valve chamber through one of said end walls thereof, a first bleed orifice of predetermined diameter and a second bleed orifice of predetermined diameter each opening through said cylindrical wall into said valve chamber on opposite sides of said first passage to effect fluid communication between said valve chamber and said fuel supply chamber, a valve means slidably positioned in said valve chamber for movement therein to selectively place said first bleed orifice and said second bleed orifice in fluid communication with said first passage, and biasing means positioned in said valve chamber to normally bias said valve to a position whereby said second bleed orifice is normally in fluid communication with said first passage, said bushing further having an upper secondary side port interconnecting said secondary cylinder with said fuel supply chamber, and a twostage plunger having a secondary piston portion and a primary piston portion axially rotatable and longitudinally reciprocable in said secondary cylinder and said primary cylinder, respectively, said primary piston portion having an upper land and a lower land operative to sequentially close the cylinder ends of said lower side port and said upper side port, respectively, during longitudinal movement of said plunger toward said outlet on a pumping stroke, said primary piston portion having a circumferentially extending groove intermediate of and defined by said upper land and said lower land, and a longitudinal passage connecting said main groove to the remote end thereof of said lower land, said secondary piston portion having land means thereon to close the cylinder end of said upper secondary side port during longitudinal movement of said plunger toward said outlet on said pumping stroke.

* * * * *

UNITED STATES PATENT AND TRADEMARK OFFICE

CERTIFICATE OF CORRECTION

PATENT NO. : 4,054,248

DATED : October 18, 1977

INVENTOR(S) : John M. Beardmore

It is certified that error appears in the above-identified patent and that said Letters Patent are hereby corrected as shown below:

Column 3, line 53, "space" should read -- spaced --.

Column 7, line 10, after "annular" insert -- fuel --.

Column 7, line 20, "increased" should read -- increases --.

Column 8, Claim 1, line 12, after "piston" insert -- portion --.

Column 9, Claim 3, line 44, after "and said" insert -- second --.

Column 9, Claim 4, line 68, "sypply" should read -- supply --.

Column 10, Claim 5, line 17, "said" second occurrence should read -- side --.

Column 10, Claim 5, line 30, "second" should read -- secondary --.

Column 12, Claim 8, line 27, "twostage" should read -- two-stage --.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*